United States Patent [19]

Gardner

[11] 4,435,880

[45] Mar. 13, 1984

[54] COLLAR CLASP

[76] Inventor: Irving Gardner, P.O. Box 294, Hunter, N.Y. 12442

[21] Appl. No.: 453,275

[22] Filed: Dec. 27, 1982

Related U.S. Application Data

[63] Continuation-in-part of Ser. No. 312,378, Oct. 19, 1981, abandoned.

[51] Int. Cl.[3] ..... A41D 25/04; A41D 25/10

[52] U.S. Cl. ..... 24/49 KC; 24/332; 24/335

[58] Field of Search ..... 24/49 KC, 335, 332, 24/90 C, 100.5, 49 C, 99.5, 263 SB, 263 R, 263 A, 61, 62, 136 B, 135 N, 341, 338; 248/63; 188/65.1

[56] References Cited

U.S. PATENT DOCUMENTS

| | | | |
|---|---|---|---|
| 945,451 | 1/1910 | Glass | 24/332 |
| 1,408,290 | 2/1922 | Guidry | 24/332 |
| 1,508,475 | 9/1924 | Pons | 24/332 |
| 1,735,387 | 11/1929 | Gnatowsky | 24/332 |
| 2,130,640 | 9/1938 | Grubb | 24/351 |
| 2,292,610 | 8/1942 | Campbell | 24/49 KC |
| 2,462,969 | 3/1949 | Holliday | 24/335 |
| 2,651,766 | 9/1953 | Runde | 24/335 |
| 2,712,167 | 7/1955 | Blanchard | 248/68 R |
| 2,771,591 | 11/1956 | Vordtriede | 24/335 |
| 2,821,762 | 2/1958 | Foose | 24/263 SB |
| 2,865,072 | 12/1958 | Klever | 24/49 KC |

FOREIGN PATENT DOCUMENTS

| | | | |
|---|---|---|---|
| 668293 | 11/1938 | Fed. Rep. of Germany | 24/338 |

*Primary Examiner*—John J. Wilson
*Attorney, Agent, or Firm*—John Maier, III

[57] ABSTRACT

A collar clasp with a backing bar and clasp bar including two slide rods between the two bars and a thread means for screwing the two bars together against the force of a spring located about the thread means.

15 Claims, 7 Drawing Figures

COLLAR CLASP

RELATED APPLICATIONS

This application is a continuation-in-part application of co-pending application Ser. No. 312,378 filed Oct. 19, 1981, now abandoned.

FIELD OF THE INVENTION

This invention relates generally to a collar clasp for holding a collar in place with a necktie.

STATEMENT OF THE PRIOR ART

An example of the prior art can be found in Gnatowsky, U.S. Pat. No. 1,735,387 which shows a collar clasp generally of the type according to this invention. Such a collar clasp is generally accepted for its intended purpose but it has not proven itself to be entirely satisfactory. Many of such collar clasps must be forced onto the collar of the wearer. The Gnatowsky Patent overcame this problem to a degree by permitting the user to press the clasp toward the center to open the clasp. Still, even Gnatowsky's improvement failed to overcome the problem satisfactorily since excessive force was required if the clasp had sufficient strength to remain properly on the collar. Therefore, with the various designs, it was a difficult problem to put on the collar clasp. If the collar clasp is sufficiently loose, as to easily be put on the collar, it will not hold the collar in place. The more rigid the clasp is, the more difficult it is to place it on the collar. The less rigid the clasp is, the more easily it will slip off the collar.

The principle object of this invention is to provide a device for an article of this character which combines easy use and simple construction along with durability.

Other objects of this invention will in part be obvious and in part hereafter pointed out.

The invention clearly consists of the features of construction, combination of elements and arrangements of parts which will be exemplified in the construction hereinafter described of which the scope of application will be indicated in the following claims.

SUMMARY OF THE INVENTION

This invention resides in a collar clasp with a clasp bar and backing bar each of which is an elongated member with a central opening and two side openings in it. A thread means is aligned with and located through the central openings of both the clasp bar and the backing bar and a spring means is located substantially concentrically about the thread means. A pair of guide rods are located in the other two openings and by turning a knurled knob associated with the thread means, the thread means and knurled knob serve to pull the clasp bar toward the backing bar against the force of the spring. The guide rods hold the backing bar and clasp bar in alignment.

The novel features which are considered as characteristic of the invention are set forth with particularity in the appended claims.

The invention itself, however, as to its construction and obvious advantages will be best understood from the following description of the specific embodiment when read with the accompanying drawings.

BRIEF DESCRIPTION OF THE DRAWINGS

In the accompanying drawings, wherein like reference characters identified the same or like part, there are shown three embodiments of this invention.

DESCRIPTION OF THE PREFERRED EMBODIMENTS

General Description of All Embodiments

Figure 2:
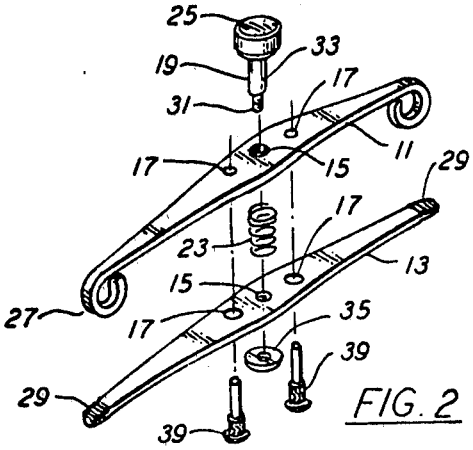
FIG. 2 is an exploded perspective view of the same embodiment shown in FIG. 1.

With reference to the drawings, there is shown and illustrated a series of three embodiments of a collar clasp constructed in accordance with the principles of the invention. In all three embodiments, there is a clasp bar 11 and a backing bar 13. Both the backing bar 13 and the clasp bar 11 have three openings in them, namely a central opening 15 and two side openings 17. The central openings 15 are located substantially midway along the major axis of both the clasp bar 11 and the backing bar 13. The two side openings 17 on both the backing bar 13 and the clasp bar 11 are located substantially equal distance from the central opening 15 along the major axis of the clasp bar 11 and are relatively close to the central opening 15. Not only the location but the spacing of the central openings 15 and side openings 17 on the clasp bar 11 and the backing bar 13 are the same.

A thread means 19 is located in and aligned with the central opening 15 in both the clasp bar 11 and the backing bar 13. A separate guide pin 21 is located in each side opening 17 in both the backing bar 13 and the clasp bar 11. A coil spring 23 may be located between the backing bar 13 and the clasp bar 11 and is generally concentrically located about the thread means 19 but all three embodiments operate satisfactorily without the spring 23. In all three embodiments, there is also a knurled knob 25 associated with the thread means 19 which when turned forces the clasp bar 11 down against the backing bar 13.

FIRST EMBODIMENT

Figure 1:
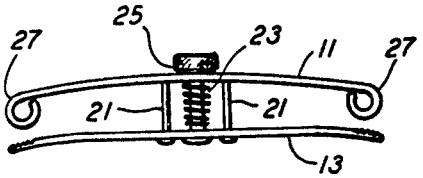
FIG. 1 is a side elevation of the first embodiment of the invention.

The clasp bar 11 in FIG. 1 has a pair of heads 27 at its ends. Each head 27 is generally circular and is formed by coiling the end of the clasp bar 11 around and under itself with the head 27 extending toward the backing bar 13. The clasp bar 11 is slightly arcuate. The backing bar 13 on the other hand, is more generally straight with a slight curve away from the clasp bar 11 at its ends. At its ends, the inner surface of the backing bar 13, which faces the clasp bar 11, has serrations 29 to create a rough surface for greater retention. The thread means 19, as seen in FIG. 2 of the first embodiment has two separate diameters, the end portion 31 of the thread means 19 having a reduced diameter and being threaded. The unthreaded portion 33 of the thread means 19, which has a larger diameter, is not threaded and serves as a stop.

Figure 7:
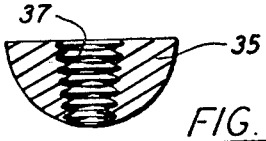
FIG. 7 is a cross-sectional view of a cap used with the thread means in the embodiments shown in the first and second embodiments.

As best seen in FIG. 7, a cap 35 with a tapered thread 37 is placed on the end portion 31 of the thread means 19 outside the backing bar 13. When the end portion 31 of the thread means 19 is turned into the cap 35, the thread means 19 is locked into the cap 35. The cap 35 serves to prevent the thread means 19 from pulling up through the backing bar 13.

The thread means 19 in the first embodiment is threaded through the backing bar 13 so that when the thread means 19 is turned, the cap 35 moves downwardly away from the underside of the backing bar 13. On the other hand, the thread means 19 only slidably engages the clasp bar 11. The knurled knob 25 on the thread means 19 of the first embodiment is rigidly secured to the thread means 19 at the end of the unthreaded portion 33 with the larger diameter so that when the knurled knob 25 is turned, the thread means 19 is screwed into the backing bar 13 and the knurled knob 25 pulls the clasp bar 11 toward the backing bar 13. The guide pins 21 are press fitted into the two side openings 17 of the backing bar 13 with small knobs 39 on the outside of the backing bar 13. The guide pins 21 slidably engage the clasp bar 11. The length of the thread means 19 is such as to prevent the pair of guide pins 21 from ever pulling out of the clasp bar 11. When the thread means 19 is threaded into the backing bar 13, the heads 27 of the clasp bar 11 are pressed against the serrations 29 at the ends of the backing bar 13. When placed on a shirt collar, the collar clasp as shown in the first embodiment, is rigidly secured in place but can be easily fitted without pressure when the thread means 19 is turned out of the backing bar 13 and the spring means or coil springs 23 between the backing bar 13 and the clasp bar 11 force the backing bar 13 and the clasp bar 11 apart.

SECOND EMBODIMENT

Figure 4:
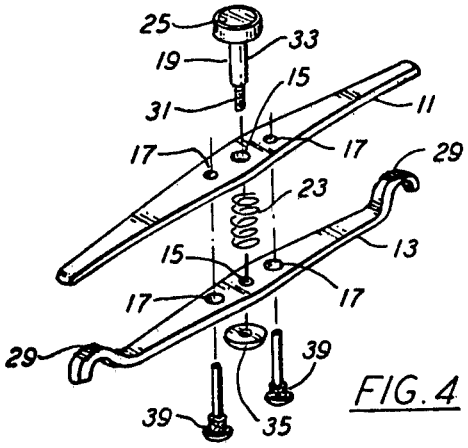
FIG. 4 is an exploded perspective view of the same embodiment shown in FIG. 3.
Figure 3:
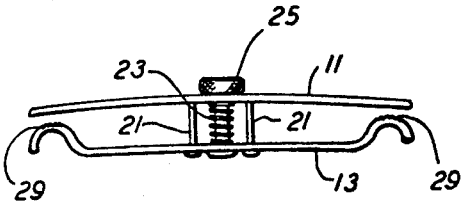
FIG. 3 is a side elevation of a second embodiment of the invention.

In the second embodiment, as best seen in FIGS. 3 and 4, the operation of the clasp bar 11 is the same as that just described for the first embodiment in FIGS. 1 and 2 except that instead of the heads 27 as shown in FIGS. 1 and 2, the backing bar 13 has a head 41 formed as an inverted U with the rounded portions extending toward the clasp bar 11 and with the serrations 29 on the inverted U facing the clasp bar 11. In all other ways, as relates to the guide pins 21, the thread means 19, the cap 35 and the knurled knob 25, the operation is identical with that already described for the first embodiment shown in FIGS. 1 and 2.

THIRD EMBODIMENT

Figure 6:
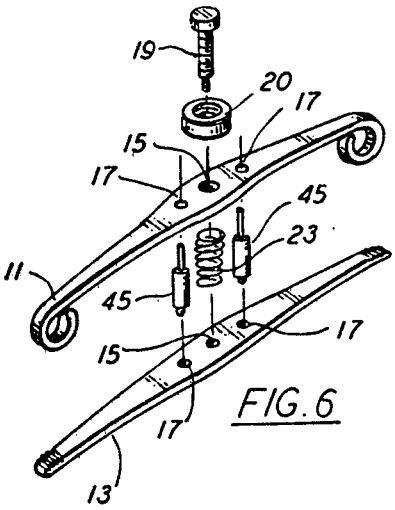
FIG. 6 is a exploded perspective view of the same embodiment shown in FIG. 5.
Figure 5:
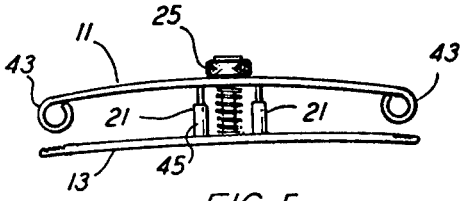
FIG. 5 is a side elevation of a third embodiment of the invention.

In the third embodiment, as shown in FIGS. 5 and 6, the heads 43 are identical in shape and is also located on the clasp bar 11 as are the heads 27 of the first embodiment as shown in FIGS. 1 and 2. These serrations 29 are located on the backing bar 13 in the same manner as shown in FIGS. 1 and 2. The guide pins 21, however, are slightly different in configuration but like the first and second embodiments are affixed to the backing bar 13 but in a different manner in that the small knobs 39 shown in FIGS. 1 through 4 are not included. The guide pins 21 in the third embodiment have an enlarged portion 45 which serves as a stop between the clasp bar 11 and the backing bar 13. The length of the enlarged portion 45 is such that when the clasp bar 11 reaches the enlarged portion 45, the collar clasp 11 is closed tightly. In the third embodiment, however, the knurled knob 25 is not affixed to the thread means 19 as it is in the first and second embodiment, but rather threadably engages the thread means 19. The spring means or coil spring 23, if utilized at all, is located at the same position about the thread means 19 as shown in the first two embodiments but the thread means 19 is affixed to the backing bar 13 rather than threadably engaging it as in the first two embodiments. Since the knurled knot 25 threadably engages the the thread means 19, the knurled knob 25 presses down against the clasp bar 11 when it is turned.

The coil spring 23, if used at all, only serves to separate the clasp bar 11 and the backing bar 13 into the open position for easy application to the collar. Although other collar clasps have used a spring, that spring serves the opposite function, namely to retain the collar clasp closed. It has been found, however, that the clasp bar opens so easily in the hand of one using it that the spring 23 can be readily eliminated.

The operation and use of the invention hereinabove described will be evident to those skilled in the art to which it relates from the consideration of the foregoing.

It will thus be seen that there is provided a device in which several objects of this invention are achieved and which is well adapted to meet the conditions of practical use. Its advantages are easily seen.

It is thought that persons skilled in the art to which this invention relates will be able to obtain a clear understanding of the invention after considering the foregoing description in connection with the accompanying drawings. Therefore, a more lengthy description is to be deemed unnecessary.

The invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning of range and equivalency of the claims are, therefore, intended to be embraced therein.

I claim:

1. A collar clasp comprising:

a backing bar including an elongated member, said backing bar having a central opening and two side openings therein, said central opening being centrally located along the major axis of said backing bar and the two side openings located substantially equally distant along said major axis on opposite sides of said central opening, both the central opening and the two side openings being grouped together;

a clasp bar including an elongated member, said clasp bar having a central opening and two side openings therein, said central opening being centrally located along the major axis of said clasp bar and the two side openings being located substantially equally distant along said major axis on opposite sides of said centrally located opening, both the central opening and the two side openings being grouped together;

a thread means including a knob aligned with and located through both the central opening in said backing bar and the central opening in said clasp bar, said thread means being adapted to draw said backing bar and said clasp bar together; and a pair of guide rods aligned with and located through the two side openings in said backing bar and the two side openings in said clasp bar to keep the clasp bar and backing bar aligned in both the open and in the closed position.

2. A collar clasp according to claim 1 wherein each guide rod is rigidly affixed to the backing bar and slidably engages the clasp bar.

3. A collar clasp according to claim 1 wherein said clasp bar has a slight arcuate bend and each end of the clasp bar has a head, each head including the end portion of the clasp bar coiled about substantially in a circle, each head extended toward said backing bar.

4. A collar clasp according to claim 2 wherein said thread means slidably engages the central opening in said clasp bar and threadably engages the central opening in said backing bar.

5. A collar clasp according to claim 1 wherein said knob is knurled and is rigidly affixed to said thread means for turning said thread means and said thread means slidably engages the central opening in said clasp bar and threadably engages the central opening in said backing bar.

6. A collar clasp according to claim 1 wherein said clasp bar has a slight arcuate bend and each end of said backing bar has a head, each head including the end portion of the backing bar coiled in an inverted U-shape, each head extending toward said clasp bar.

7. A collar clasp according to claim 6 wherein said knob is knurled and is rigidly affixed to said thread means for turning said thread means and said thread means slidably engages the central opening in said clasp bar and threadably engages the central opening in said backing bar.

8. A collar clasp according to claim 1 wherein the knurled knob threadably engages said thread means and wherein said thread means is affixed to the central opening in said backing bar and slidably engages said clasp bar.

9. A collar clasp according to claim 1 including a spring means located substantially concentrically about said thread means and between said backing bar and said clasp bar.

10. A collar clasp comprising:

a backing bar including an elongated member, said backing bar having a central opening and two side openings therein, said central opening being centrally located along the major axis of said backing bar and the two side openings being located substantially equally distant along said major axis on opposite sides of said central opening, both the central opening and the two side openings being grouped together;

a clasp bar including an elongated member with a slight arcuate bend, said clasp bar having a central opening and two side openings therein, said central opening being centrally located along the major axis of said clasp bar and the two side openings being located substantially equally distant along said major axis on opposite sides of said centrally located opening, both the central opening and the two side openings being grouped together;

a thread means including a knurled knob aligned with and located through both the central opening in said backing bar and the central opening in said clasp bar, said thread means being adapted to draw said backing bar and said clasp bar together; and a pair of guide rods aligned with and located through the two side openings in said backing bar and the two side openings in said clasp bar to keep the clasp bar and backing bar aligned in both the open and in the closed position, each guide bar being rigidly affixed to the backing bar while slidably engaging the clasp bar.

11. A collar clasp according to claim 10 wherein each end of said backing bar has a head, each head including the end portion of the backing bar curled in an inverted U-shape, each head extending toward said clasp bar.

12. A collar clasp according to claim 11 wherein said knurled knob is rigidly affixed to said thread means for turning said thread means and wherein said thread means slidably engages the central opening in said clasp bar and threadable engages the central opening in said backing bar.

13. A collar clasp according to claim 10 wherein each end of the clasp has a head, each head including the end portion of the clasp bar coiled about substantially in a circle, each head extended toward said backing bar.

14. A collar clasp according to claim 13 wherein said knurled knob is rigidly affixed to said thread means for turning said thread means and wherein said thread means slidably engages the central opening in said clasp bar and threadable engages the central opening in said backing bar.

15. A collar clasp according to claim 13 wherein the knurled knob threadably engages said thread means and wherein said thread means is affixed to the central opening in said backing bar and slidably engages said clasp bar.

* * * * *